US010849416B2

(12) United States Patent
Hohlbein

(10) Patent No.: US 10,849,416 B2
(45) Date of Patent: Dec. 1, 2020

(54) ORAL CARE IMPLEMENT

(71) Applicant: Colgate-Palmolive Company, New York, NY (US)

(72) Inventor: Douglas Hohlbein, Hopewell, NJ (US)

(73) Assignee: Colgate-Palmolive Company, New York, NY (US)

( * ) Notice: Subject to any disclaimer, the term of this patent is extended or adjusted under 35 U.S.C. 154(b) by 328 days.

(21) Appl. No.: 15/757,984

(22) PCT Filed: Sep. 8, 2015

(86) PCT No.: PCT/US2015/048917
§ 371 (c)(1),
(2) Date: Mar. 7, 2018

(87) PCT Pub. No.: WO2017/044072
PCT Pub. Date: Mar. 16, 2017

(65) Prior Publication Data

US 2018/0242725 A1 Aug. 30, 2018

(51) Int. Cl.

| | |
|---|---|
| ***A46B 9/04*** | (2006.01) |
| ***A46B 13/02*** | (2006.01) |
| ***A46B 9/02*** | (2006.01) |
| ***A46B 9/06*** | (2006.01) |

(52) U.S. Cl.
CPC ..... *A46B 9/028* (2013.01); *A46B 9/025* (2013.01); *A46B 9/04* (2013.01); *A46B 9/06* (2013.01); *A46B 2200/1066* (2013.01)

(58) Field of Classification Search
CPC ..... A46B 9/04; A46B 9/028; A46B 13/02
See application file for complete search history.

(56) References Cited

U.S. PATENT DOCUMENTS

| | | | |
|---|---|---|---|
| 2,508,799 | A | 5/1950 | Reis, Jr. |
| 6,871,373 | B2 | 3/2005 | Driesen et al. |
| 7,934,284 | B2 | 5/2011 | Braun et al. |
| 8,387,196 | B2 | 3/2013 | Jimenez et al. |
| 8,444,416 | B2 | 5/2013 | Chenvainu et al. |

(Continued)

FOREIGN PATENT DOCUMENTS

| | | |
|---|---|---|
| CN | 1575688 | 2/2005 |
| CN | 102481045 | 8/2014 |

(Continued)

OTHER PUBLICATIONS

International Search Report and Written Opinion of the International Searching Authority in International Application No. PCT/US2015/048917, dated May 17, 2016.

*Primary Examiner* — Michael D Jennings

(57) ABSTRACT

An oral care implement having a head with a front surface and a plurality of contact elements extending from the head. The plurality of contact elements are arranged in a pattern that may have the visual appearance of a flower. Specifically, the pattern may comprise a first set of contact elements arranged in a first loop about a reference axis and a second set of contact elements arranged in a second loop that surrounds the first loop. The pattern may also include a third set of contact elements arranged in a third loop that surrounds the second loop. Each of the contact elements of the first, second, and third sets may be inclined relative to the front surface of the head so as to diverge from the reference axis.

19 Claims, 7 Drawing Sheets

(56) References Cited

U.S. PATENT DOCUMENTS

| | | | | |
|---|---|---|---|---|
| 8,453,288 | B2 | 6/2013 | Driesen et al. | |
| 8,763,194 | B2 * | 7/2014 | Jimenez | A46B 9/06 15/110 |
| 8,789,228 | B2 | 7/2014 | Driesen et al. | |
| 8,863,345 | B2 | 10/2014 | Jimenez et al. | |
| 9,364,303 | B2 * | 6/2016 | Driesen | A61C 17/3436 |
| 2003/0033680 | A1 | 2/2003 | Davies et al. | |
| 2003/0163881 | A1 * | 9/2003 | Driesen | A46B 9/025 15/22.1 |
| 2006/0248667 | A1 * | 11/2006 | Kraemer | A46B 9/025 15/28 |
| 2010/0299857 | A1 | 12/2010 | Stief et al. | |
| 2010/0306941 | A1 | 12/2010 | Erskine-Smith et al. | |
| 2011/0247154 | A1 | 10/2011 | Driesen et al. | |
| 2013/0007969 | A1 * | 1/2013 | Driesen | A61C 17/3436 15/28 |
| 2015/0327665 | A1 | 11/2015 | Hohlbein | |

FOREIGN PATENT DOCUMENTS

| | | |
|---|---|---|
| CN | 104320992 | 6/2017 |
| DE | 1997717 | 12/1968 |
| EP | 0663162 | 7/1995 |
| JP | 2014204788 | 10/2014 |
| RU | 2171085 | 7/2001 |
| WO | 2011/028604 | 3/2011 |
| WO | 2013/005184 | 1/2013 |

* cited by examiner

ORAL CARE IMPLEMENT

BACKGROUND

The oral care implement industry is rather competitive and innovation of an oral care implement with desirable aesthetics can be financially beneficial to a seller of such products. Specifically, although oral care implements are increasingly being designed with cleaning elements or bristles having unique benefits, it is often the overall visual appearance of an oral care implement that drives sales rather than its unique benefits. Part of the reason for this is that it is difficult to inform the consumer that the oral care implement provides a specific benefit. Thus, a need exists for an oral care implement that has a unique visual appearance and that readily communicates benefits of using the oral care implement to a consumer.

BRIEF SUMMARY

The present invention may be directed, in one aspect, to an oral care implement having a head with a front surface and a plurality of contact elements extending from the head. The plurality of contact elements are arranged in a pattern that may have the visual appearance of a flower. Specifically, the pattern may comprise a first set of contact elements arranged in a first loop about a reference axis, a second set of contact elements arranged in a second loop that surrounds the first loop, and a third set of contact elements arranged in a third loop that surrounds the second loop. In some embodiments, each of the contact elements of the first, second, and third sets may be inclined relative to the front surface of the head so as to diverge from the reference axis.

In one embodiment, the invention can be an oral care implement comprising: a head having a front surface; a plurality of contact elements extending from the front surface of the head, the plurality of contact elements arranged in a pattern comprising: a first set of arcuate contact elements arranged in a first loop about a reference axis, each arcuate contact element of the first set inclined relative to the front surface at a first angle so as to diverge from the reference axis; a second set of arcuate contact elements arranged in a second loop that surrounds the first loop, each arcuate contact element of the second set inclined relative to the front surface at a second angle so as to diverge from the reference axis, the second angle being greater than the first angle; and a third set of arcuate contact elements arranged in a third loop that surrounds the second loop, one or more of the arcuate contact elements of the third set inclined relative to the front surface at a third angle so as to diverge from the reference axis, the third angle being greater than the second angle.

In another embodiment, the invention can be an oral care implement comprising: a head having a front surface; a plurality of contact elements extending from the front surface of the head, the plurality of contact elements arranged in a pattern comprising: a first set of contact elements arranged in a first loop about a reference axis, each contact element of the first set inclined relative to the front surface so as to diverge from the reference axis; and a second set of contact elements arranged in a second loop that surrounds the first loop, each contact element of the second set inclined relative to the front surface so as to diverge from the reference axis.

In yet another embodiment, the invention can be an oral care implement comprising: a head having a front surface; a plurality of contact elements extending from the front surface of the head, the plurality of contact elements arranged in a pattern comprising: a first set of arcuate bristle tufts arranged in a first loop about a reference axis; and a second set of arcuate bristle tufts arranged in a second loop that surrounds the first loop.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
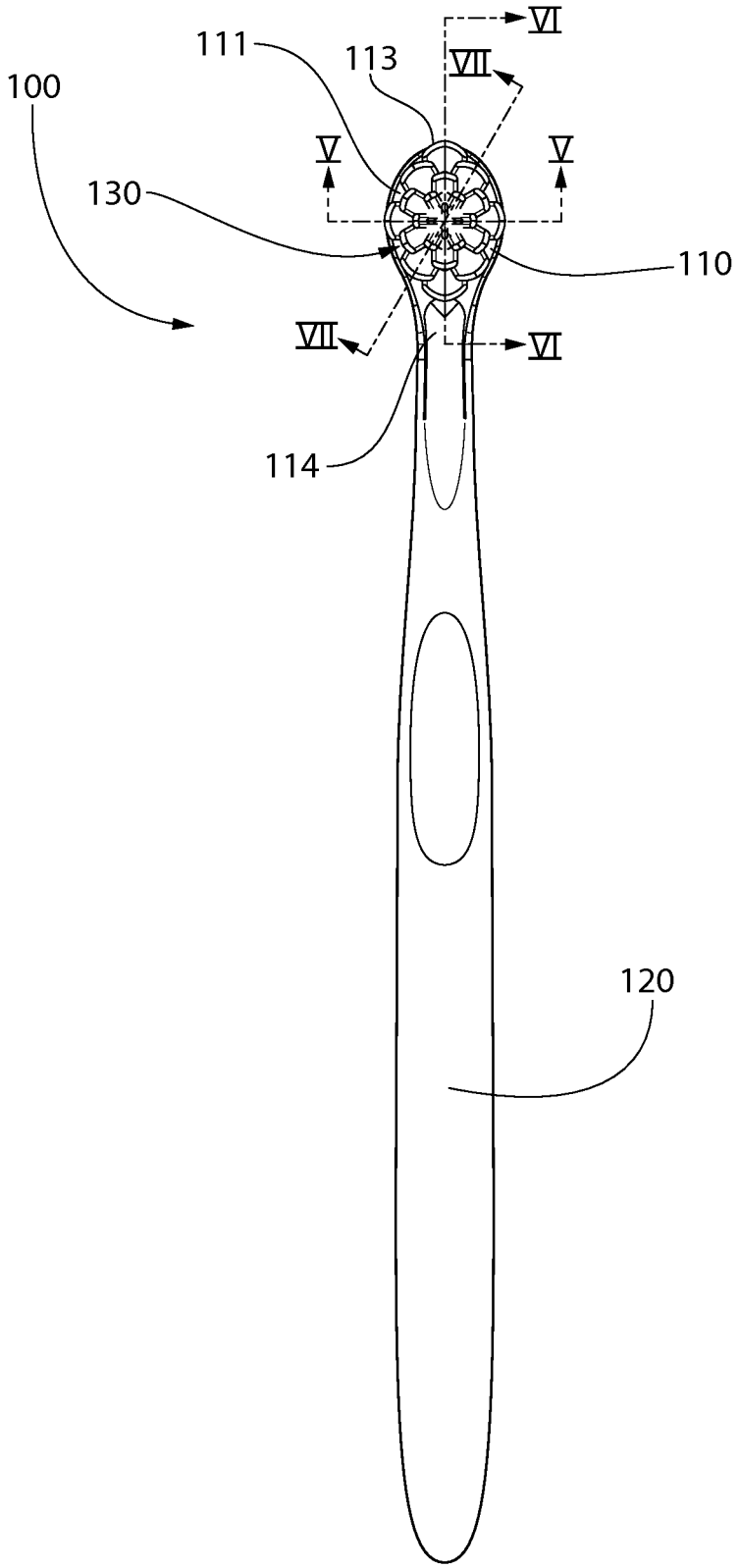
FIG. 1 is a front perspective view of an oral care implement in accordance an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring first to FIG. 1, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, an interdental device, a tooth polisher, a specially designed ansate implement having tooth engaging elements, or any other type of implement that is commonly used for oral care. Furthermore, in still other embodiments the implement may not be limited to one that is used for oral care, and may be a personal care implement such as a hairbrush or the like. Thus, it is to be understood that the inventive concepts discussed herein can be applied to any type of oral or personal care implement unless a specific type of oral or personal care implement is specified in the claims.

The oral care implement 100 comprises a head 110 and a handle 120 that are coupled together. In the exemplified embodiment, the head 110 is formed integrally with the handle 120 as a single unitary structure using a molding, milling, machining, or other suitable process. However, in other embodiments the head 110 and the handle 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. The head 110 and the handle 120 may, in certain embodiments, be formed of a rigid plastic material such as polymers and copolymers of ethylene, propylene, butadiene, vinyl compounds, polyesters such as polyethylene terephthalate (PET), styrene-acrylonitrile (SAN), polyurethane, polyamide, cellulosic, acrylic, acrylonitrile butadiene styrene (ABS), or the like. Of course, the head 110 and the handle 120 are not limited to any particular material of construction unless specifically claimed as such.

The handle 120 is an elongated structure that provides the mechanism by which the user can hold and manipulate the oral care implement 100 during use. In the exemplified embodiment, the handle 120 is generically depicted having various contours for user comfort. Of course, the invention is not to be limited by the specific shape illustrated for the handle 120 in all embodiments and in certain other embodiments the handle 120 can take on a wide variety of shapes, contours, and configurations, none of which are limiting of the present invention unless so specified in the claims. In certain embodiments the rigid material of the handle 120 may be partially covered with a thermoplastic elastomer to increase grip comfort and decrease slippage during use of the oral care implement 100.

The head 110 extends from the distal end of the handle 120 and forms the portion of the oral care implement 100 that is inserted into a user's mouth during brushing to clean a user's oral surfaces (i.e., teeth, gums, and soft tissue surfaces). The head 110 extends from a proximal end 114 adjacent to the handle 120 to a free or distal end 113. The head 110 comprises a front surface 111 and an opposing rear surface 112. In the exemplified embodiment, a plurality of contact elements 130 are coupled to and extend from the front surface 111 of the head 110. The term "contact elements" is used in a generic sense to refer to any structure that can be used to clean, polish, or wipe the teeth and/or soft oral tissue (e.g. tongue, cheek, gums, etc.) through relative surface contact. Common examples of "contact elements" include, without limitation, bristle tufts, filament bristles, fiber bristles, nylon bristles, tapered bristles, spiral bristles, rubber bristles, elastomeric protrusions, flexible lamella, flexible polymer protrusions, combinations thereof and/or structures containing such materials or combinations. In certain embodiments each of the contact elements 130 on the head 110 is a bristle tuft comprising bristles. In such embodiments the contact elements 130 may include tapered bristles, non-tapered (i.e., end rounded) bristles, spiral bristles, etc., and combinations thereof. Any combination of the various types of tooth cleaning elements may be used on the oral care implement 100 in different embodiments.

In embodiments that use elastomeric elements as one or more of the contact elements 130, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used. The contact elements 130 may be coupled to the head 110 using any technique known in the art, such as stapling, anchor free tufting (AFT), in-mold tufting (IMT), AMR, injection molding, or the like. The invention is not to be limited by the manner in which the contact elements 130 are coupled to the head 110 in all embodiments. However, in certain embodiments anchorless tufting processes may be preferred.

In certain embodiments, a tongue or soft tissue cleaner (not depicted) formed of a thermoplastic elastomer or the like may be positioned on the rear surface 112 of the head 110. Such a tongue or soft tissue cleaner may include nubs, ribs, depressions, or the like to enhance the cleaning effect.

The plurality of contact elements 130 are arranged on the head 120 in a specific pattern that in the exemplified embodiment has the visual appearance of a flower pattern. Specifically, the individual contact elements are positioned and arranged in such a manner that the contact elements form loops that are offset relative to one another and angled relative to the head. Thus, the pattern of the plurality of contact elements 130 resembles the pattern of the petals of a flower.

Figure 2:
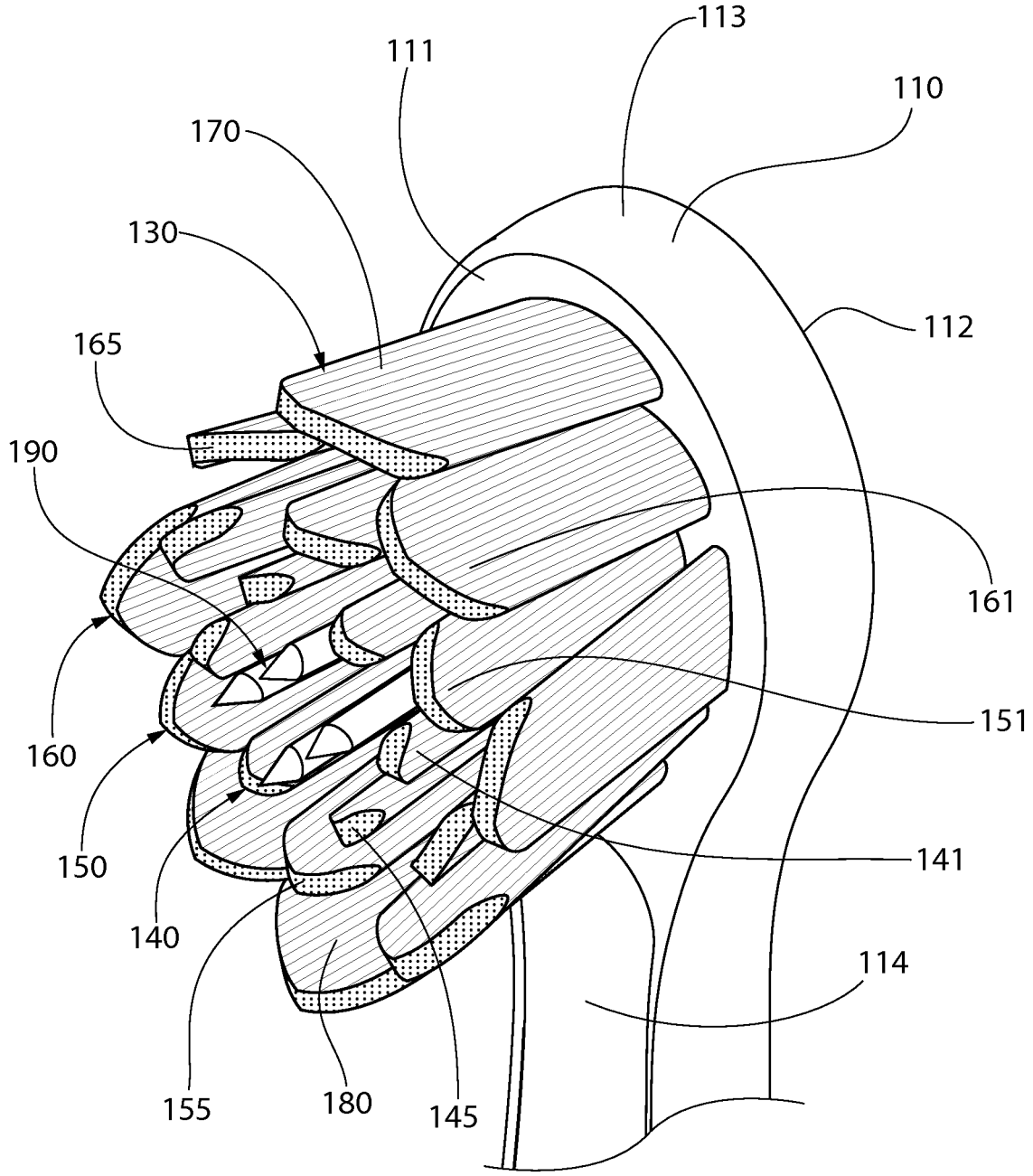
FIG. 2 is a close-up front perspective view of a head of the oral care implement of FIG. 1.
Figure 3:
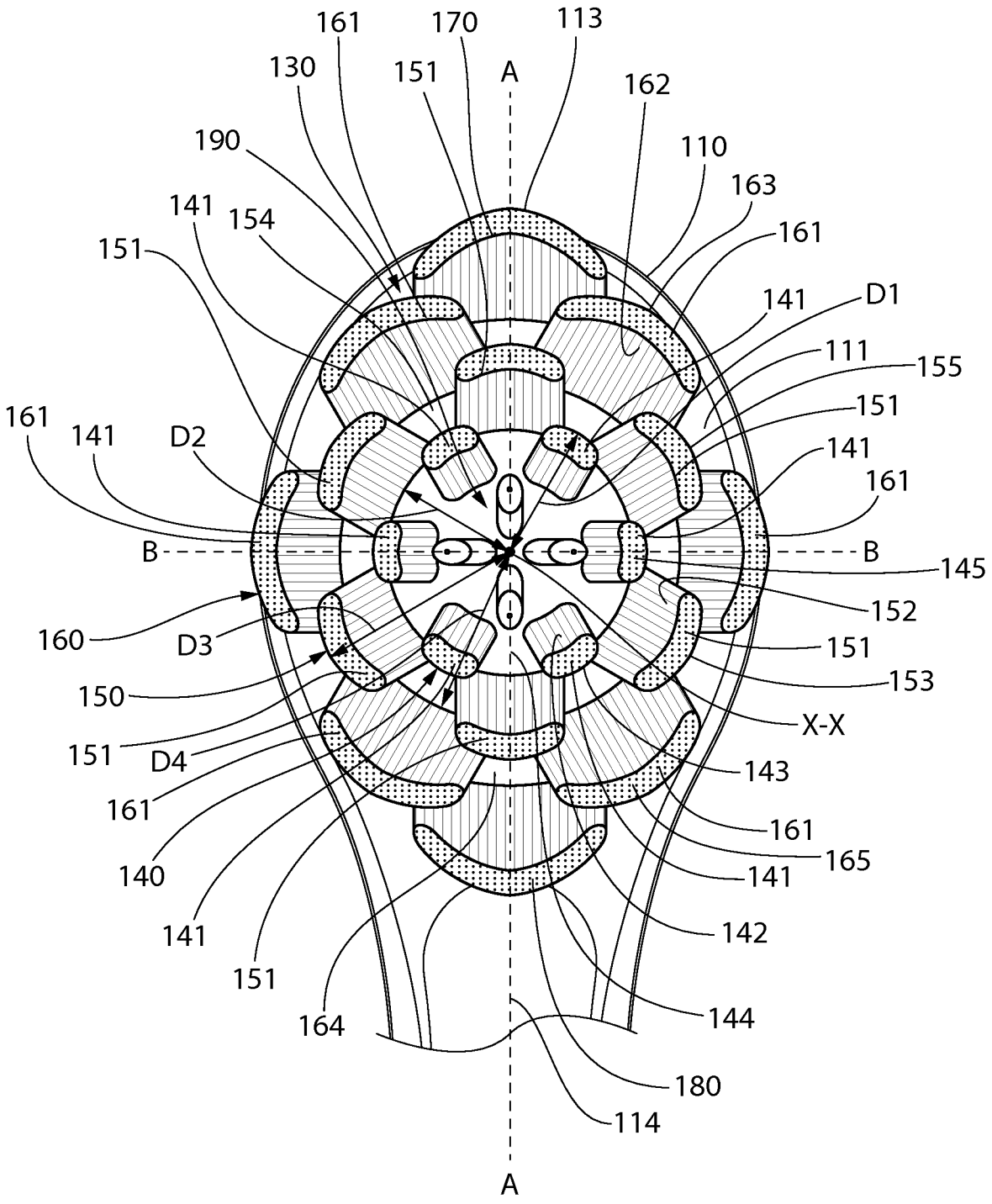
FIG. 3 is a close-up front view of the head of the oral care implement of FIG. 1
Figure 4:
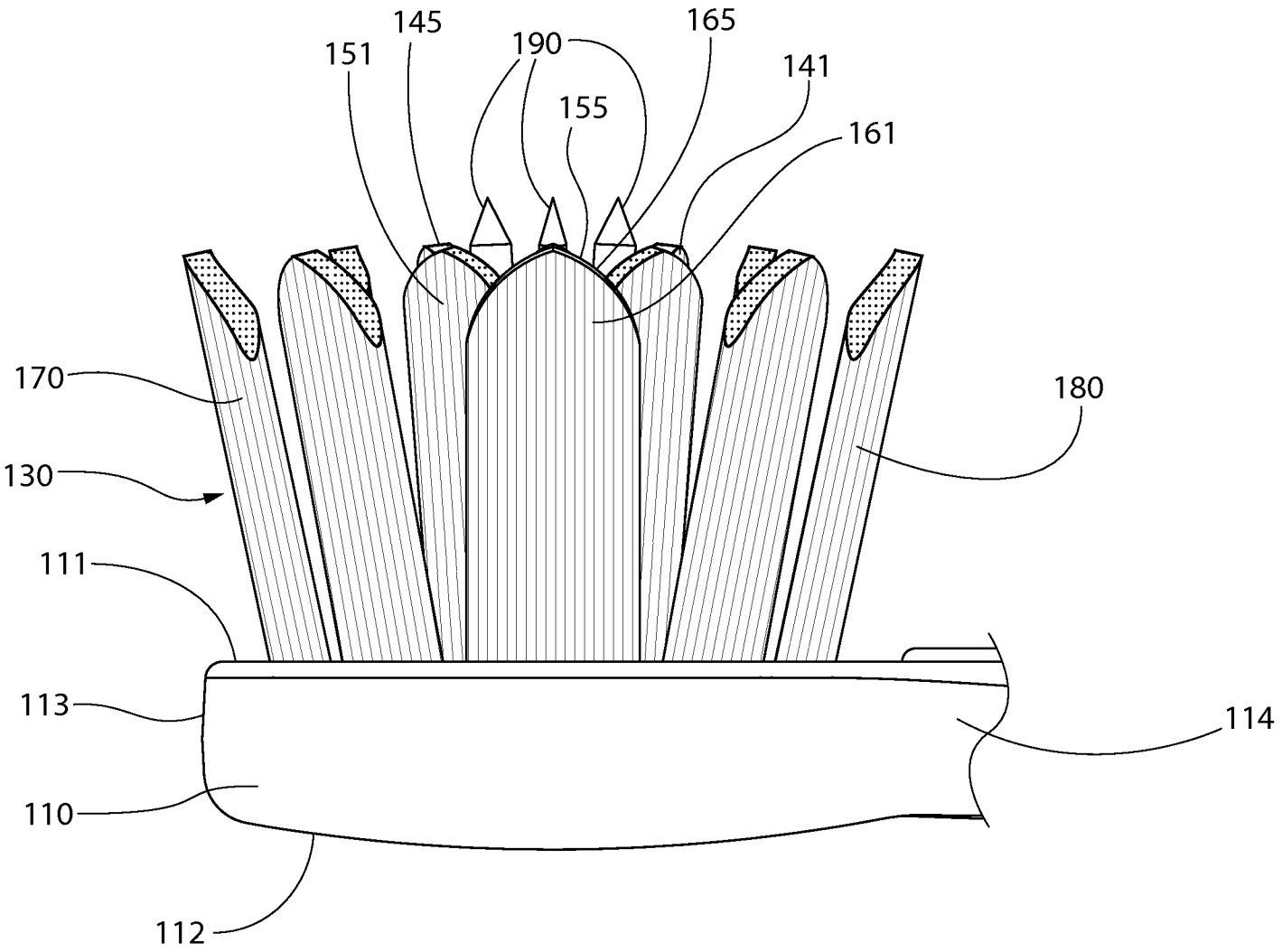
FIG. 4 is a close-up side view of the head of the oral care implement of FIG. 1.
Figure 5:
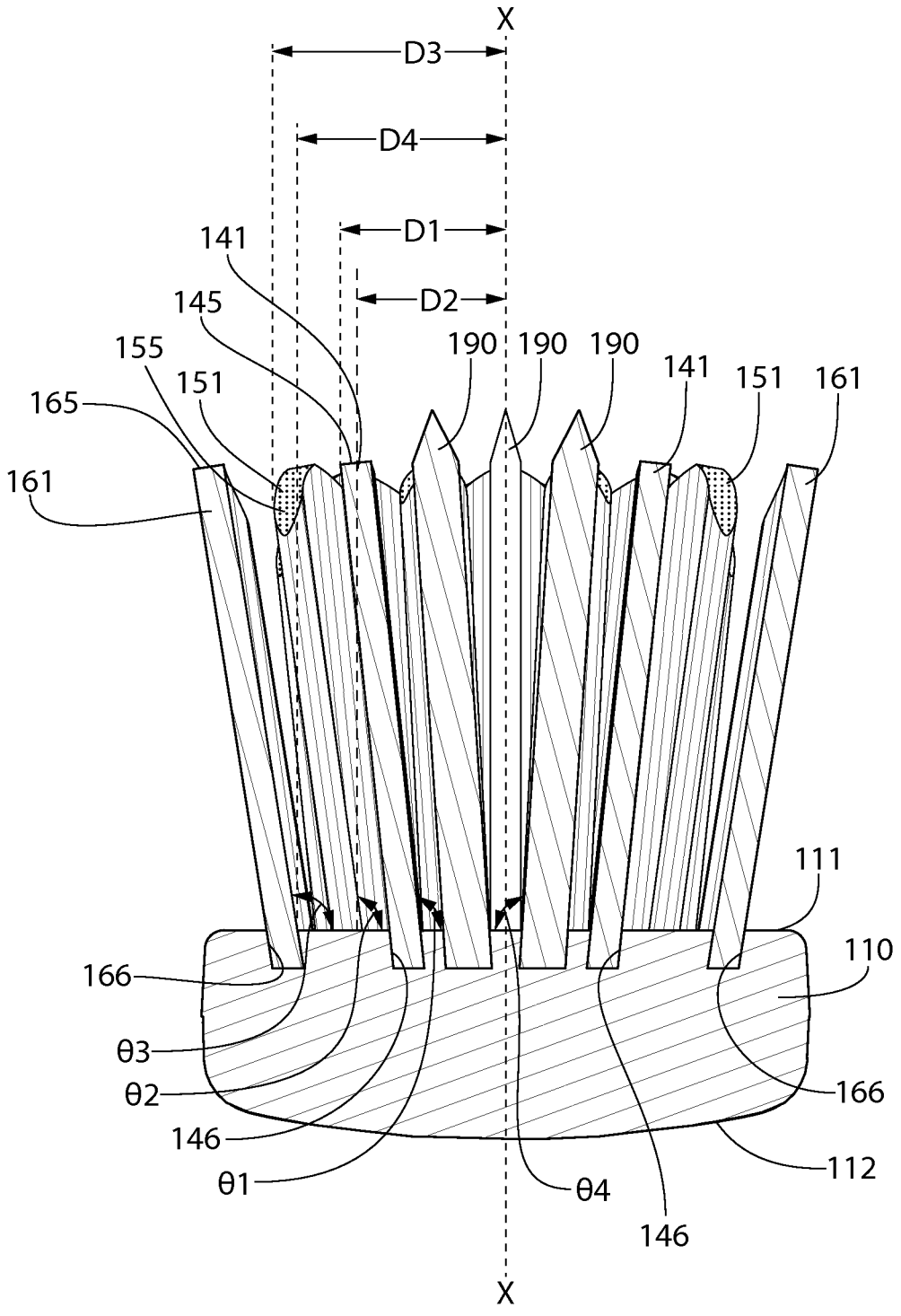
FIG. 5 is a cross-sectional view taken along line V-V in FIG. 1.
Figure 6:
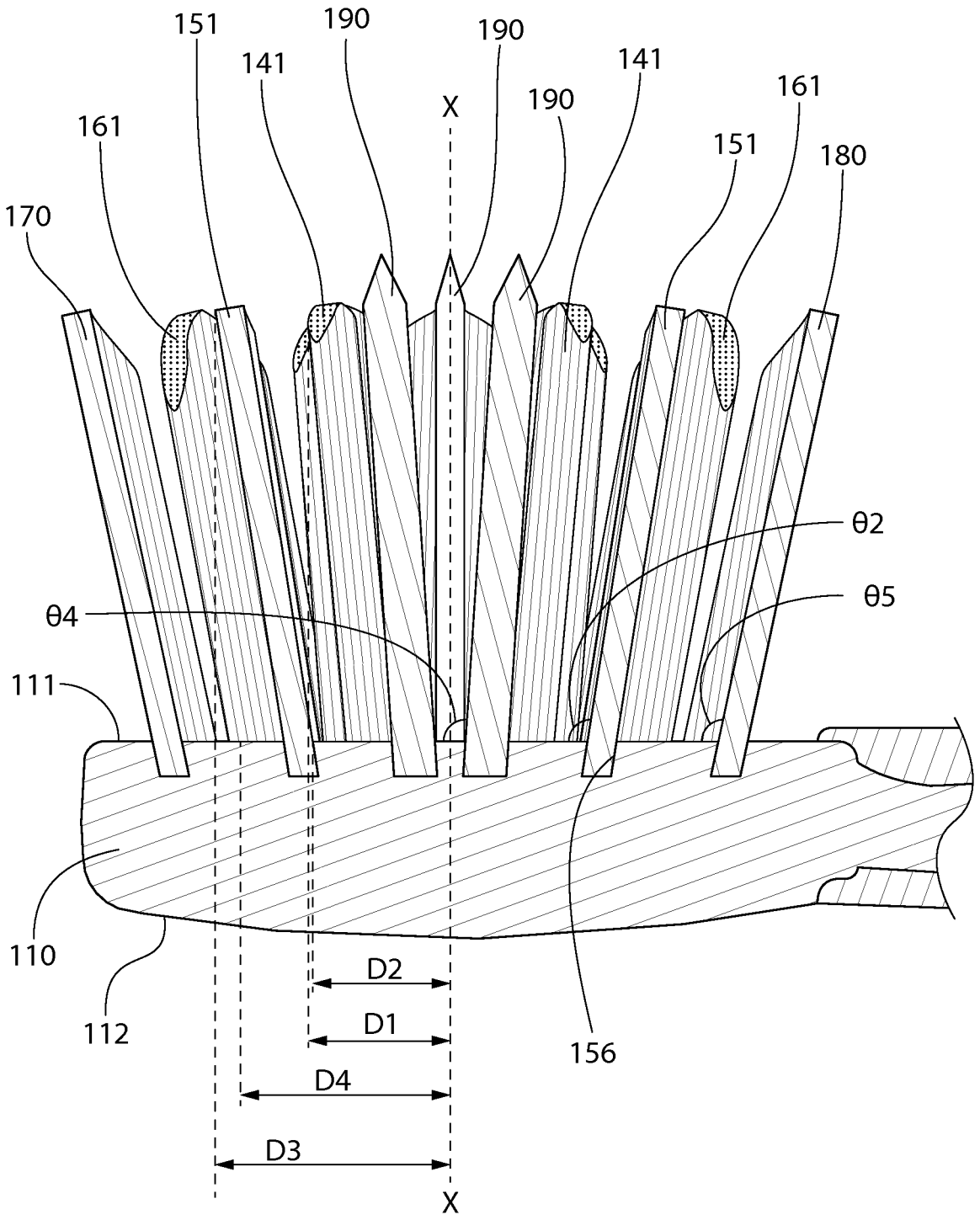
FIG. 6 is a cross-sectional view taken along line VI-VI in FIG. 1.
Figure 7:
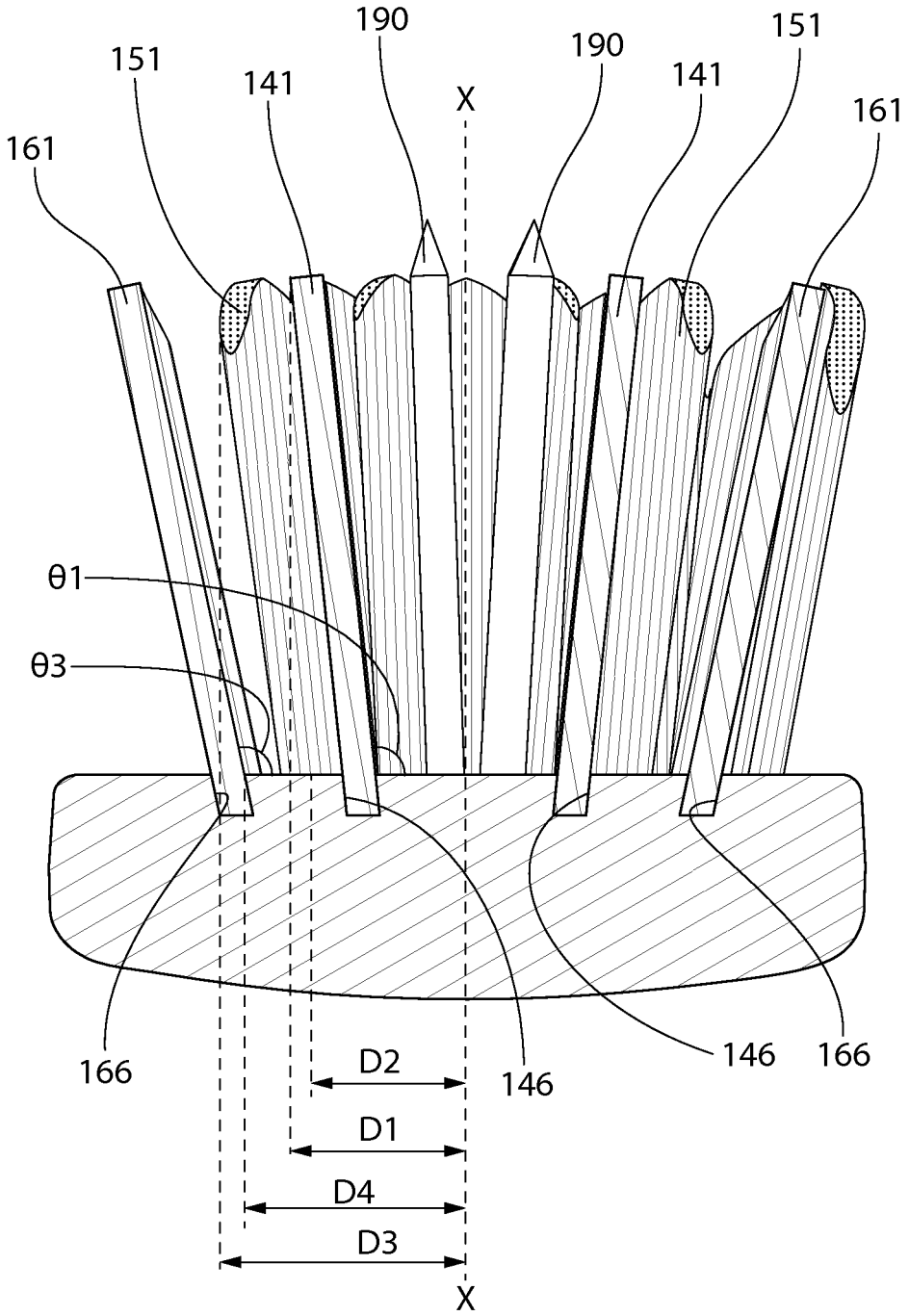
FIG. 7 is a cross-sectional view taken along line VII-VII in FIG. 1.

Referring to FIGS. 2-4 concurrently, the pattern of the plurality of contact elements 130 will be described in more detail. The head 110 of the oral care implement 100 comprises a reference axis X-X that will serve as a reference point in describing the relationship among the plurality of contact elements 130. The reference axis X-X is an axis that passes through and is perpendicular to the front and rear surfaces 111, 112 of the head 110 and that intersects both a longitudinal axis A-A of the head 110 and a transverse axis B-B of the head 110. In certain embodiments the reference axis X-X may be positioned centrally on the head 110 equidistant from the proximal and distal ends 113, 114 of the head 110 and equidistant from the opposing lateral sides of the head 110.

The pattern of the plurality of contact elements 130 comprises a first set of contact elements 140 arranged in a first loop about the reference axis X-X. In the exemplified embodiment, the first set of contact elements 140 comprises six separate contact elements 141. Of course, the first set of contact elements 140 may include more or less than six contact elements 141 in other embodiments. Furthermore, in the exemplified embodiment each of the contact elements 141 is a bristle tuft comprising a plurality of bristles. More specifically, in the exemplified embodiment each of the contact elements 141 is a bristle tuft extending from its own tuft hole such that each contact element 141 of the first set of contact elements 140 extends from a separate tuft hole. Thus, in the exemplified embodiment the first set of contact elements 140 comprises six contact elements 141 (or bristle tufts) each extending from a separate and distinct tuft hole. When the contact elements 141 are bristle tufts, the bristle tufts may comprise tapered bristles, spiral bristles, cylindrical bristles, and/or combinations thereof.

Of course, the invention is not to be limited to the first set of contact elements 140 comprising bristle tufts and the first set of contact elements 140 may comprise elastomeric elements or other types of elements commonly used for tooth and soft tissue cleaning in other embodiments. In certain embodiments the first set of contact elements 140 may include some contact elements 141 that are bristle tufts and other contact elements 141 that are elastomeric elements. However, in such embodiments each contact element 141 still extends from its own tuft hole in the head 110 such that the contact elements 141 that make up the first set of contact elements 140 are spaced apart from one another. In the exemplified embodiment, each of the contact elements 141 of the first set of contact elements 140 are circumferentially spaced apart from one another about or along the first loop. Stated another way, adjacent ones of the contact elements 141 are spaced apart by a first gap 144 so that the first set of contact elements 140 includes six independent, isolated, and separate contact elements 141. In the exemplified embodiment, no portion of adjacent ones of the contact elements 141 are in contact with one another.

In the exemplified embodiment, each of the contact elements 141 is an arcuate shaped tuft of bristles. Thus, the first set of contact elements 140 may be referred to herein as a first set of arcuate contact elements or a first set of arcuate bristle tufts in some instances. In the exemplified embodiment, the contact elements 141 of the first set of arcuate contact elements 140 comprises an inner concave surface 142 facing the reference axis X-X and an outer convex surface 143 facing away from the reference axis X-X. Although illustrated in the drawings and described herein as being arcuate, the contact elements 141 need not be arcuate in shape in all embodiments. The contact elements 141 may instead have planar and non-arcuate surfaces in other embodiments.

The pattern of the plurality of contact elements 130 also comprises a second set of contact elements 150 arranged in a second loop about the reference axis X-X. The second set of contact elements 150 are arranged in a second loop that surrounds the first loop. Thus, the first loop formed by the first set of contact elements 140 has a first diameter and the second loop formed by the second set of contact elements 150 has a second diameter, the second diameter being greater than the first diameter. In the exemplified embodiment, the second set of contact elements 150 comprises six separate contact elements 151. Of course, the second set of contact elements 150 may include more or less than six contact elements 151 in other embodiments. Furthermore, in the exemplified embodiment each of the contact elements 151 is a bristle tuft comprising a plurality of bristles. More specifically, in the exemplified embodiment each of the contact elements 151 is a bristle tuft extending from its own tuft hole such that each contact element 151 of the second set of contact elements 150 extends from a separate tuft hole. Thus, in the exemplified embodiment the second set of contact elements 150 comprises six contact elements 151 (or bristle tufts) each extending from a separate and distinct tuft hole. When the contact elements 151 are bristle tufts, the bristle tufts may comprise tapered bristles, spiral bristles, cylindrical bristles, and/or combinations thereof.

Of course, the invention is not to be limited to the second set of contact elements 150 comprising bristle tufts and the second set of contact elements 150 may comprise elastomeric elements or other types of elements commonly used for tooth and soft tissue cleaning in other embodiments. In certain embodiments the second set of contact elements 150 may include some contact elements 151 that are bristle tufts and other contact elements 151 that are elastomeric elements. However, in such embodiments each contact element 151 still extends from its own tuft hole in the head 110 such that the contact elements 151 that make up the second set of contact elements 150 are spaced apart from one another. In the exemplified embodiment, each of the contact elements 151 of the second set of contact elements 150 are circumferentially spaced apart from one another about or along the second loop. Stated another way, adjacent ones of the contact elements 151 are spaced apart by a second gap 154 so that the second set of contact elements 150 includes six independent, isolated, and separate contact elements 151. In the exemplified embodiment, no portion of adjacent ones of the contact elements 151 are in contact with one another.

In the exemplified embodiment, each of the contact elements 151 is an arcuate shaped tuft of bristles. Thus, the second set of contact elements 150 may be referred to herein as a second set of arcuate contact elements or arcuate bristle tufts in some instances. In the exemplified embodiment, the contact elements 151 of the second set of arcuate contact elements 150 comprises an inner concave surface 152 facing the first set of contact elements 140 and the reference axis X-X and an outer convex surface 153 facing away from the first set of contact elements 140 and the reference axis X-X. Although illustrated in the drawings and described herein as being arcuate, the contact elements 151 need not be arcuate in shape in all embodiments. The contact elements 151 may instead have planar and non-arcuate surfaces in other embodiments.

The pattern of the plurality of contact elements 130 also comprises a third set of contact elements 160 arranged in a third loop about the reference axis X-X. The third set of contact elements 160 are arranged in a third loop that surrounds the second loop. Thus, the third loop formed by the third set of contact elements 160 has a third diameter that is greater than the first diameter of the first loop and the second diameter of the second loop. In the exemplified embodiment, the third set of contact elements 160 comprises six separate contact elements 161. Of course, the third set of contact elements 160 may include more or less than six contact elements 161 in other embodiments. Furthermore, in the exemplified embodiment each of the contact elements 161 is a bristle tuft comprising a plurality of bristles. More specifically, in the exemplified embodiment each of the contact elements 161 is a bristle tuft extending from its own tuft hole such that each contact element 161 of the second set of contact elements 160 extends from a separate tuft hole. Thus, in the exemplified embodiment the third set of contact elements 160 comprises six contact elements 161 (or bristle tufts) each extending from a separate and distinct tuft hole. When the contact elements 161 are bristle tufts, the bristle tufts may comprise tapered bristles, spiral bristles, cylindrical bristles, and/or combinations thereof.

Of course, the invention is not to be limited to the third set of contact elements 160 comprising bristle tufts and the third set of contact elements 160 may comprise elastomeric elements or other types of elements commonly used for tooth and soft tissue cleaning in other embodiments. In certain embodiments the third set of contact elements 160 may include some contact elements 161 that are bristle tufts and other contact elements 161 that are elastomeric elements. However, in such embodiments each contact element 161 still extends from its own tuft hole in the head 110 such that the contact elements 161 that make up the third set of contact elements 160 are spaced apart from one another. In the exemplified embodiment, each of the contact elements 161 of the third set of contact elements 160 are circumferentially spaced apart from one another about or along the second loop. Stated another way, adjacent ones of the contact elements 161 are spaced apart by a third gap 164 so that the third set of contact elements 160 includes six independent, isolated, and separate contact elements 161. In the exemplified embodiment, no portion of adjacent ones of the contact elements 161 are in contact with one another. In certain embodiments each of the first, second, and third gaps 144, 154, 164 has the same length measured along the respective loops.

In the exemplified embodiment, each of the contact elements 161 is an arcuate shaped tuft of bristles. Thus, the third set of contact elements 160 may be referred to herein as a third set of arcuate contact elements or arcuate bristle tufts in some instances. In the exemplified embodiment, the contact elements 161 of the third set of arcuate contact elements 160 comprises an inner concave surface 162 facing the second set of contact elements 150 and the reference axis X-X and an outer convex surface 163 facing away from the second set of contact elements 150 and the reference axis X-X. Although illustrated in the drawings and described herein as being arcuate, the contact elements 161 need not be arcuate in shape in all embodiments. The contact elements 161 may instead have planar and non-arcuate surfaces in other embodiments.

As best seen in FIG. 3, there are no bristle tufts or other contact or tooth cleaning elements positioned between adjacent ones of the first, second, and third loops. Specifically, the second loop of the second set of contact elements 150 is positioned between the first loop of the first set of contact elements 140 and the third loop of the third set of contact elements 160. There are no contact elements of any type positioned between the first set of contact elements 140 and the second set of contact elements 150. Similarly, there are no contact elements of any type positioned between the second set of contact elements 150 and the third set of contact elements 160.

Each of the contact elements 141 of the first set of contact elements 140 has a first arc length measured along the first loop and a first height measured from the front surface 111 of the head 110 to a distal surface 145 of the contact element 141. Each of the contact elements 151 of the second set of contact elements 150 has a second arc length measured along the second loop and a second height measured from the front surface 111 of the head 110 to a distal surface 155 of the contact element 151. Each of the contact elements 161 of the third set of contact elements 160 has a third arc length measured along the third loop and a third height measured from the front surface 111 of the head 110 to a distal surface 165 of the contact element 161. In certain embodiments the third arc length is greater than the second arc length and the second arc length is greater than the first arc length. Furthermore, in the exemplified embodiment the first, second, and third heights are the same although the invention is not to be so limited in all embodiments and in certain other embodiments the first, second, and third heights may be different.

The first, second, and third sets of contact elements 140, 150, 160 are arranged so that the contact elements 151 of the second set of contact elements 150 are offset from the contact elements 141, 161 of the first and third sets of contact elements 140, 160. Specifically, as noted above the contact elements 141 of the first set of contact elements 140 are arranged about the first loop in a spaced apart manner so that the first gaps 144 are formed between adjacent ones of the contact elements 141 of the first set of contact elements 140. Similarly, the contact elements 161 of the third set of contact elements 160 are arranged about the third loop in a spaced apart manner so that the third gaps 164 are formed between adjacent ones of the contact elements 161 of the third set of contact elements 160. The contact elements 151 of the second set of contact elements 150 are positioned so as to be aligned with the first gaps 144 between the adjacent ones of the contact elements 141 of the first set of contact elements 140 and the third gaps 164 between the adjacent ones of the contact elements 161 of the third set of contact elements 160.

The offset arrangement of the second set of contact elements 150 relative to the first and third sets of contact elements 140, 160 results in the following. In the first loop the longitudinal axis A-A intersects two of the gaps 144 between adjacent contact elements 141 and the transverse axis B-B intersects two of the contact elements 141. In the second loop the longitudinal axis A-A intersects two of the contact elements 151 and the transverse axis intersects two of the gaps 154 between adjacent contact elements 151. In the third loop the longitudinal axis A-A intersects two of the gaps 164 between adjacent contact elements and the transverse axis intersects two of the contact elements 161.

The first arc length of the first contact elements 141 is greater than the length of the second gaps 154 between adjacent ones of the second contact elements 151. The second arc length of the second contact elements 151 is greater than the length of the first gaps 144 between adjacent ones of the first contact elements 141 and the length of the third gaps 164 between adjacent ones of the third contact elements 161. The third arc length of the third contact elements 161 is greater than the length of the second gaps 154 between adjacent ones of the second contact elements 151. Thus, each of the first contact elements 141 overlaps two of the second contact elements 151, each of the second contact elements 151 overlaps two of the first contact elements 141 and two of the third contact elements 161, and each of the third contact elements 161 overlaps two of the second contact elements 151. This overlap facilitates in the formation of the flower pattern described herein.

As best seen in FIG. 4, each of the contact elements 141 of the first set 140 terminates in a convex distal surface 145 when viewed in side profile. Similarly, each of the contact elements 151 of the second set 150 terminates in a convex distal surface 155 when viewed in side profile. Furthermore, each of the contact elements 161 of the third set 160 terminates in a convex distal surface 165 when viewed in side profile. The convex distal surfaces 145, 155, 165 are entirely formed by the distal-most or terminal surface of the contact elements 141, 151, 161. Specifically, each of the contact elements 141, 151, 161 has an inner concave surface 142, 152, 162 facing the reference axis X-X and an outer convex surface 143, 153, 163 facing away from the reference axis X-X. The distal surfaces 145 155, 165 of the contact elements 141, 151, 161 are surfaces that extend between the inner concave surfaces 142, 152, 162 and the outer convex surfaces 143, 153, 163 of the contact elements 141, 151, 161 that face upwardly away from the front surface 111 of the head 110. These distal surfaces 145, 155, 165 are convex.

In addition to the contact elements 141, 151, 161 of the first, second, and third sets 140, 150, 160, the plurality of contact elements 130 also comprise a distal-most contact element 170 located outside of the third loop and adjacent the distal end 113 of the head 110 and a proximal-most contact element 180 located outside of the third loop and adjacent the proximal end 114 of the head 110. Each of the distal-most and proximal-most contact elements 170, 180 are aligned on and intersected by the longitudinal axis A-A. In the exemplified embodiment, each of the distal-most and proximal-most contact elements 170, 180 is arcuate in shape having a concave surface facing the third loop and the reference axis X-X and a convex surface facing away from the third loop and the reference axis X-X. However, the invention is not to be so limited and the distal-most and proximal-most contact elements 170, 180 may be non-arcuate in other embodiments. Furthermore, the distal-most and proximal-most contact elements 170, 180 may be omitted in some embodiments.

In the exemplified embodiment, each of the distal-most and proximal-most contact elements 170, 180 is aligned with one of the third gaps 164 between adjacent ones of the third contact elements 161 of the third set of contact elements 160. Furthermore, each of the distal-most and proximal-most contact elements 170, 180 extends along an arc length that is greater than a length of the third gap 164 with which it is aligned. Thus, each of the distal-most and proximal-most contact elements 170, 180 overlaps two of the contact elements 161 of the third set of contact elements 160.

The plurality of contact elements 130 also comprise a plurality of central contact elements 190 located within the first loop formed by the first set of contact elements 140. In the exemplified embodiment four central contact elements 190 are illustrated, although more or less than four central contact elements 190 are possible in other embodiments. Furthermore, in the exemplified embodiment the central contact elements 190 are arranged in a cruciform pattern about the reference axis X-X. Thus, two of the central contact elements 190 are positioned on the longitudinal axis A-A on opposite sides of the reference axis X-X and two of the central contact elements 190 are positioned on the transverse axis B-B on opposite sides of the reference axis X-X. In the exemplified embodiment, each of the central contact elements 190 positioned on the longitudinal axis A-A is aligned with one of the first gaps 144 between adjacent ones of the contact elements 141 of the first set of contact elements 140. Furthermore, in the exemplified embodiment each of the central contact elements 190 positioned on the transverse axis B-B is aligned with one of the contact elements 141.

Each of the central contact elements 190 terminates in a conical surface. Thus, each of the central contact elements 190 is a tapered element. The central contact elements 190 may be individual bristles, tufts of bristles, elastomeric elements, or any other type of contact element as described herein above. Each of the central contact elements 190 has a height measured from the front surface 111 of the head 110 to the distal end of the central contact element 190. The height of the central contact elements 190 is greater than the heights of the contact elements 141, 151, 161 of the first, second, and third sets of contact elements 140, 150, 160. Furthermore, in certain embodiments each of the central contact elements 190 may be a first color and each of the contact elements 141, 151, 161 of the first, second, and third sets 140, 150, 160 may be a second color that is different than the first color.

Referring to FIGS. 3 and 5-7 concurrently, the oral care implement 100 will be further described. Each of the contact elements 141, 151, 161 of the first, second, and third sets 140, 150, 160 are inclined relative to the front surface 111 of the head 110 so as to diverge from the reference axis X-X. Thus, the contact elements 141 of the first set 140 are angled away from the reference axis X-X and towards the contact elements 151 of the second set 150. The contact elements 151 of the second set 150 are angled away from the reference axis X-X (and away from the contact elements 141 of the first set 140) and towards the contact elements 161 of the third set 160. The contact elements 161 of the third set 160 are angled away from the reference axis X-X (and away from the contact elements 151 of the second set 150) and towards a perimeter of the head 110 (and towards the distal-most and proximal-most contact elements 170, 180). The central contact elements 190 and the proximal-most and distal-most contact elements 170, 180 are similarly angled away from the reference axis X-X so as to diverge from the reference axis X-X. To further indicate the manner of inclination, each of the contact elements 141, 151, 161, 170, 180, 190 has a bottom portion that is on the same plane as the front surface 111 of the head 110 and a distal portion. The bottom portions of each of the contact elements 141, 151, 161, 170, 180, 190 is located closer to the reference axis A-A than the distal portions of each of the contact elements 141, 151, 161, 170, 180, 190.

More specifically, the contact elements 141 of the first set 140 are inclined relative to the front surface 111 of the head 110 at a first angle ⊖1. The contact elements 151 of the second set 150 are inclined relative to the front surface 111 of the head 110 at a second angle ⊖2. The contact elements 161 of the third set 160 are inclined relative to the front surface 111 of the head 110 at a third angle ⊖3. In certain embodiments as described below, all of the contact elements 161 of the third set 160 may not be oriented at the same angle. Specifically, the contact elements 161 located on the transverse axis B-B may be oriented at one angle and the remaining contact elements 161 may be oriented at a different angle. In certain embodiments the angle of the contact elements 161 positioned on the transverse axis B-B may be a smaller angle than the angle of the remaining contact elements 161. Exemplary ranges and specific numeric values for these angles are provided below.

The central contact elements 190 are inclined relative to the front surface 111 of the head 110 at a fourth angle ⊖4. The distal-most and proximal-most contact elements 170, 180 are inclined relative to the front surface of the head at a fifth angle ⊖5. In the exemplified embodiment, the fifth angle ⊖5 is greater than the fourth angle ⊖4, the fourth angle ⊖4 is greater than the third angle ⊖3, third angle ⊖3 is greater than the second angle ⊖2, and the second angle ⊖2 is greater than the first angle ⊖1. In certain embodiments, the contact elements 161 on the transverse axis B-B are oriented at the same angle as the second angle ⊖2 and the other contact elements 161 are oriented at an angle that is greater than the second angle ⊖2. Thus, the contact elements 130 become more steeply angled with distance from the reference axis X-X. All of the angles ⊖1-⊖5 are taken between the front surface 111 of the head 110 and the inner surfaces of the contact elements 141, 151, 161, 170, 180, 190 that face the reference axis X-X.

In certain embodiments, the first angle ⊖1 may be between 94° and 97°, and more specifically approximately 96°, the second angle ⊖2 may be between 98° and 100°, and more specifically approximately 99°, and the third angle ⊖3 may be between 98° and 103°. More specifically, in certain embodiments some of the tufts 161 may be oriented at a third angle ⊖3 which is approximately 99° and other of the tufts 161 may be oriented at a third angle ⊖3 that is approximately 102°. Even more specifically, in certain embodiments the tufts 161 that are oriented at a 99° angle are the tufts 161 located on the transverse axis B-B and the remaining tufts 161 are oriented at a 102° angle. In certain embodiments, the fourth angle ⊖4 may be between 91° and 95°, and more specifically approximately 93.75° or 94°. In certain embodiments the fifth angle ⊖5 may be between 100° and 105°, and more specifically approximately 102°. Of course, all of the specific angles set forth herein are provided as one exemplary embodiment. It should be appreciated that angles within and outside of the provided ranges are possible in other embodiments while still achieving the flower pattern of the contact elements 130.

Each of the contact elements 141 is positioned within a first tuft hole 146 formed into the front surface 111 of the head 110, each of the contact elements 151 is positioned within a second tuft hole 156 formed into the front surface 111 of the head 110, and each of the contact elements 161 is positioned within a third tuft hole 166 formed into the front surface 111 of the head 110.

In the exemplified embodiment, the contact elements 141 of the first set 140 terminate in distal surfaces 145 having outermost edges located a first radial distance D1 from the reference axis X-X. The contact elements 151 of the second set 150 extend from a set of the second tuft holes 156 having an innermost edge located a second radial distance D2 from the reference axis X-X. In the exemplified embodiment the first radial distance D1 is greater than the second radial distance D2. Thus, the distal surfaces 145 of the contact elements 141 of the first set 140 are located further from the reference axis X-X than the innermost edge of the second tuft holes 156 from which the contact elements 151 of the second set 150 extend.

Furthermore, in the exemplified embodiment the contact elements 151 of the second set 150 terminate in distal surfaces 155 having outermost edges located a third radial distance D3 from the reference axis X-X and the contact elements 161 of the third set 160 extend from a set of the third tuft holes 166 having an innermost edge located a fourth radial distance D4 from the reference axis X-X. In the exemplified embodiment the third radial distance D3 is greater than the fourth radial distance D4. Thus, the distal surfaces 155 of the contact elements 151 of the second set 150 are located further from the reference axis X-X than the innermost edge of the third tuft holes 166 from which the contact elements 161 of the second set 160 extend.

Due to the angle of inclination of the contact elements 141 of the first set 140 and the spacing between the first, second, and third sets of contact elements 140, 150 160, an axis that is parallel to the reference axis X-X that intersects the distal surface 145 of one of the contact elements 141 will also intersect either one of the second gaps 154 between adjacent ones of the contact elements 151 of the second set 150 or a portion of one of the contact elements 151. Similarly, an axis that is parallel to the reference axis X-X that intersects the distal surface 155 of one of the contact elements 151 will also intersect either one of the third gaps 164 between adjacent ones of the contact elements 161 of the third set 160 or a portion of one of the contact elements 161. This angled orientation of the contact elements 141, 151, 161 enhances the flower pattern appearance of the plurality of contact elements 130.

In certain embodiments, the flower pattern of the plurality of contact elements 130 may provide a unique visual appearance that communicates a unique benefit of the oral care implement 100 to a consumer. Specifically, at least some of the plurality of contact elements 130 or all of the plurality of contact elements 130 may comprise tapered bristle filaments. Tapered bristle filaments on an oral care implement are known to create a soft mouth feel during use. The flower pattern illustrated in the figures and described herein may be indicative or representative of this soft mouth feel achieved during brushing with the oral care implement.

In other embodiments, some or all of the plurality of contact elements 130 may comprise an active agent, such as a natural ingredient including without limitation lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+. The flower pattern of the plurality of contact elements 130 may visually communicate to a consumer that the contact elements include a natural ingredient. Specifically, the appearance of a flower may communicate that the contact elements have a natural active agent ingredient.

Unique cleaning benefits may be achieved with the design of the oral care implement 100 described herein. Specifically, as the head 110 of the oral care implement 100 is stroked away from the gum line, contact elements 141, 151, 161, 170, 180, 190 that are aligned with the interstitial spaces between teeth will generally be stiffer to better penetrate hard to reach spaces between teeth. This increased stiffness is the result of the alignment of the contact elements 141, 151, 161, 170, 180, 190 making up the contact elements 141, 151, 161, 170, 180, 190 that are parallel to the interstitial space. A further benefit of such an arrangement of contact elements 141, 151, 161, 170, 180, 190 would be further enhanced by brushing with the dentist recommended circular motion. The circular pattern of the plurality of contact elements 130 will serve as a reminder to the consumer to comply with such a regimen. Further, the resulting force each contact element 141, 151, 161, 170, 180, 190 exerts will dynamically change with the force vectors being applied at any given moment. That is, contact elements 141, 151, 161, 170, 180, 190 aligned with the brushing force vector will be stiffer than those perpendicular thereto.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a head having a front surface;

a plurality of contact elements extending from the front surface of the head, the plurality of contact elements arranged in a pattern comprising:

a first set of arcuate contact elements arranged in a first loop about a reference axis, each arcuate contact element of the first set inclined relative to the front surface at a first angle so as to diverge from the reference axis;

a second set of arcuate contact elements arranged in a second loop that surrounds the first loop, each arcuate contact element of the second set inclined relative to the front surface at a second angle so as to diverge from the reference axis, the second angle being greater than the first angle; and a third set of arcuate contact elements arranged in a third loop that surrounds the second loop, one or more of the arcuate contact elements of the third set inclined relative to the front surface at a third angle so as to diverge from the reference axis, the third angle being greater than the second angle.

2. The oral care implement according to claim 1 wherein the arcuate contact elements of the second set are circumferentially offset from the arcuate contact elements of the first and third sets.

3. The oral care implement according to claim 1 wherein each of the arcuate contact elements of the first, second, and third sets terminates in a convex distal surface in side profile.

4. The oral care implement according to claim 1 wherein each of the arcuate contact elements of the first set extends a first arc length, each of the arcuate contact elements of the second set extends a second arc length, each of the arcuate contact elements of the third set extends a third arc length, the second arc length being greater than the first arc length, and the third arc length being greater than the second arc length.

5. The oral care implement according to claim 1 wherein the pattern is a flower pattern.

6. The oral care implement according to claim 1 wherein the plurality of contact elements further comprises: a distalmost arcuate contact element located outside of the third loop and adjacent a distal end of the head; and a proximalmost arcuate contact element located outside of the third loop and adjacent a proximal end of the head.

7. The oral care implement according to claim 1 wherein each of the arcuate contact elements of the first, second, and third sets is a bristle tuft.

8. The oral care implement according to claim 1 wherein the plurality of contact elements further comprises a plurality of central contact elements located within the first loop.

9. The oral care implement according to claim 1 wherein adjacent ones of the arcuate contact elements in the first set are separated from one another by a first gap; wherein adjacent ones of the arcuate contact elements in the second set are separated from one another by a second gap; and wherein adjacent ones of the arcuate contact elements in the third set are separated from one another by a third gap.

10. The oral care implement according to claim 1 wherein each of the arcuate contact elements of the first, second, and third sets extends from a separate tuft hole.

11. The oral care implement according to claim 1 wherein the arcuate contact elements of the first set terminate in distal surfaces having outermost edges located a first radial distance from the reference axis; wherein the arcuate contact elements of the second set extend from a set of second tuft holes having an innermost edge located a second radial distance from the reference axis, the first radial distance being greater than the second radial distance; wherein the arcuate contact elements of the second set terminate in distal surfaces having outermost edges located a third radial distance from the reference axis; and wherein the arcuate contact elements of the third set extend from a set of third tuft holes having an innermost edge located a fourth radial distance from the reference axis, the third radial distance being greater than the fourth radial distance.

12. An oral care implement comprising:

a head having a front surface;

a plurality of contact elements extending from the front surface of the head, the plurality of contact elements arranged in a pattern comprising:

a first set of contact elements arranged in a first loop about a reference axis, each contact element of the first set inclined relative to the front surface so as to diverge from the reference axis;

a second set of contact elements arranged in a second loop that surrounds the first loop, each contact element of the second set inclined relative to the front surface so as to diverge from the reference axis; and a third set of contact elements arranged in a third loop that surrounds the second loop, each contact element of the third set inclined relative to the front surface so as to diverge from the reference axis.

13. The oral care implement according to claim 12 wherein the contact elements of the second set are circumferentially offset from the contact elements of the first and third sets.

14. The oral care implement according to claim 12 wherein each of the contact elements of the first set extends a first arc length, each of the contact elements of the second set extends a second arc length, each of the contact elements of the third set extends a third arc length, the second arc length being greater than the first arc length, and the third arc length being greater than the second arc length.

15. The oral care implement according to claim 12 wherein each contact element of the first set is inclined relative to the front surface at a first angle and each contact element of the second set is inclined relative to the front surface at a second angle, the second angle being greater than the first angle.

16. An oral care implement comprising:

a head having a front surface;

a plurality of contact elements extending from the front surface of the head, the plurality of contact elements arranged in a pattern comprising:

a first set of arcuate bristle tufts arranged in a first loop about a reference axis; and a second set of arcuate bristle tufts arranged in a second loop that surrounds the first loop;

wherein the first set of arcuate bristle tufts have one or more gaps between adjacent pairs of arcuate bristle tufts, and wherein the arcuate bristle tufts of the second set are circumferentially offset from the arcuate bristle tufts of the first set such that the one or more gaps of the first set of arcuate bristle tufts aligned with one or more bristle tufts of the second set of arcuate bristle tufts.

17. The oral care implement according to claim 16 further comprising a third set of arcuate bristle tufts arranged in a third loop that surrounds the second loop, wherein the arcuate bristle tufts of the second set are circumferentially offset from the arcuate bristle tufts of the first and third sets.

18. The oral care implement according to claim 16 further comprising:

each arcuate bristle tuft of the first set inclined relative to the front surface at a first angle so as to diverge from the reference axis; and each arcuate bristle tuft of the second set inclined relative to the front surface at a second angle so as to diverge from the reference axis;

wherein the second angle is greater than the first angle.

19. The oral care implement according to claim 16 wherein each of the arcuate bristle tufts of the first and second sets extends from a separate tuft hole.

* * * * *